US006413148B1

(12) United States Patent
Beary

(10) Patent No.: US 6,413,148 B1
(45) Date of Patent: Jul. 2, 2002

(54) GRINDING JIG FOR FIREARM RECOIL PADS

(76) Inventor: Joseph Alfred Beary, 10 Jefferson Pl., Port Hadlock, WA (US) 98339

( * ) Notice: Subject to any disclaimer, the term of this patent is extended or adjusted under 35 U.S.C. 154(b) by 0 days.

(21) Appl. No.: 09/765,809

(22) Filed: Jan. 18, 2001

(51) Int. Cl.[7] ..... B24B 1/00

(52) U.S. Cl. ..... 451/28; 451/367; 451/386; 451/387

(58) Field of Search ..... 451/28, 364, 365, 451/367, 370, 378, 380, 386, 387; 269/303, 304, 308, 309

(56) References Cited

U.S. PATENT DOCUMENTS

| | | | | |
|---|---|---|---|---|
| 150,717 | A | | 5/1874 | Scott |
| 2,765,596 | A | | 10/1956 | Norgiel et al. |
| 3,007,272 | A | | 11/1961 | Pachmayr |
| 3,674,451 | A | | 7/1972 | Hameister et al. |
| 3,992,823 | A | | 11/1976 | Pachmayr |
| 4,142,332 | A | * | 3/1979 | Clarke ..... 51/125 |
| 5,265,366 | A | | 11/1993 | Thompson |
| 5,375,360 | A | | 12/1994 | Vatterott |
| 5,457,901 | A | | 10/1995 | Gernstein et al. |
| 5,582,542 | A | * | 12/1996 | Stein ..... 451/367 |
| 5,811,720 | A | | 9/1998 | Quinnell et al. |
| 5,974,718 | A | | 11/1999 | Bentley |
| 5,979,098 | A | | 11/1999 | Griggs |
| 6,254,455 | B1 | * | 7/2001 | Irvine et al. ..... 451/28 |

OTHER PUBLICATIONS

The B–Square Company, The B–Square Recoil Pad Jig Instruction sheet (date unknown).
B & R Recoil Pad Fitting Jig advertisement (date unknown).
B & R Recoil Pad Jig instruction sheet (date unknown).

* cited by examiner

*Primary Examiner*—Timothy V. Eley
*Assistant Examiner*—Dung Van Nguyen
(74) *Attorney, Agent, or Firm*—McDonnell Boehnen Hulbert & Berghoff

(57) ABSTRACT

A grinding jig for shaping generic recoil pads to custom fit the butt end of a gunstock. The jig includes an upright and a recoil pad mounting arm that function as an angle-capturing device. The upright and pad mounting arm are adjusted so that they fit flush against the butt and top or toe portions of the gunstock. The pad is then mounted in an upside down position on the pad mounting arm. The jig, with attached recoil pad, is then manually manipulated to bear against a vertically disposed sanding or grinding instrument.

12 Claims, 14 Drawing Sheets

ROTATION
110
102
104
106
16
36
34
48
49
47
54
46
32
112

16
12
180°-α
S
EXCESS
α
PLANE OF
SANDER/GRINDER
EXCESS
112
α
180°-α
21
36
16
32

48
α
34
94
38
46

GRINDING JIG FOR FIREARM RECOIL PADS

BACKGROUND OF THE INVENTION

A. Field of the Invention

This invention relates generally to the field of firearms and the art of gunsmithing. More particularly, the invention relates to a jig device for use in grinding individual recoil pads for a firearm. The jig enables a gunsmith to grind a recoil pad having a profile and perimeter shape that matches the contours of the gunstock, resulting in a well fitting and aesthetically pleasing fit and finish to the recoil pad.

B. Description of Related Art

Firearms, typically rifles, incorporate recoil pads on the butt end of the gunstock in order to absorb some of the shock when the weapon is fired. The patent literature describes many different styles and types of recoil pads, see e.g., Scott, U.S. Pat. No. 150,717, Pachmayr, U.S. Pat. No. 3,007,272 and Vatterott, U.S. Pat. No. 5,375,360. Such pads are available from Pachmeyer Gun Works of Los Angeles, Calif., among others. Most patents generally say little or nothing about how the pads are custom fitted to a particular gunstock.

Two patents describing the production of recoil pads and the shaping of the recoil pad to fit the recoil pads to the shape of the stock in a mass-production setting are Pachmayr, et al., U.S. Pat. No. 3,992,823 and Hameister et al., U.S. Pat. No. 3,674,451. It is also common practice to manufacture generic recoil pads, such as the recoil pad described in the above-referenced Pachmeyer '272 patent, which are thereafter custom fitted to an individual rifle. Since these recoil pads are generic (i.e., not sized or shaped to fit any particular rifle) and therefore are oversized, consequently they must be ground or sanded down to fit flush with the gunstock of the rifle. Typically, the user mounts a generic, oversized pad to the butt end of the gunstock and then holds the pad against the surface of a grinding or sanding instrument. This process risks marring the finish of the gunstock, e.g., where the sander accidentally brushes against the gunstock. The Pachmeyer '823 and Hameister patents describe complex and costly machinery that may work well in a factory or mass-production setting, but such machines are unsuitable for the small gunsmith shop or individual gun owner who may wish to custom fit a generic recoil pad to an individual rifle.

Some time ago, a pad grinding jig was commercialized by B-Square, which is illustrated in FIG. 1. The jig consists of a base 2 and an adjustable mounting bracket 3 for mounting to a recoil pad 16. The pad is mounted upside down via two machine screw 5 that fasten the pad to two machine screw holes formed in the top surface of the mounting bracket 3, as shown. The stock angle is found my means of a square 4 as shown in FIG. 1. Setting the angle requires not only holding onto the square and the gunstock 12, but also tightening the allen screw 6 to set the angle. This is a trial and error task, as the mounting bracket 3 tends to move as the screw 6 is tightened, necessitating rechecking the angle with the square 4 again to be certain that the angle has not changed. As is shown in the top view of FIG. 1A, the jig is shown with the pad attached, held off center relative to the gunstock 12 to allow the square 4 to lay on the center of the gunstock 12. This is very awkward for the gunsmith to achieve with only two hands.

After the angle is found, the pad, attached to the jig 2/3, is ground by means of a sander. After the grinding is done, the pad 16 is removed from the jig. The machine screws 5 are removed from the pad, and the screws that mount the pad to the gunstock are reinserted into the same screw holes, and the pad is permanently mounted to the gunstock. The insertion of the machine screws into the pad, and subsequent removal, and then re-inserting of the pad mounting screws, tends to tear up or mar the slit area of the pad 16, making for an unsightly finished product.

The present invention presents an improvement over known jigs for grinding recoil pads. It enables a recoil pad to be simply and easily ground prior to permanently mounting the pad to the gunstock. The jig also includes angle finding features that enable the recoil pad to be ground such that it fits perfectly flush with the gunstock with a smooth, flowing continuity of the gunstock surfaces and the surface of the recoil pad. Moreover, the use of the jig does not mar the pad, since the same screws that mount the pad to the gunstock are used and they are not repeatedly installed and then removed from the pad, as is the case with the machine screws of the B-square jig.

SUMMARY OF THE INVENTION

A jig is provided for use in grinding or sanding a generic, over-sized recoil pad to a desired custom shape to fit the butt end of a gunstock. The jig includes a base that serves as a flat support for the jig on a worktable or other surface. The jig also includes an upright or vertically extending member that is oriented perpendicular to the base. The jig also includes a pad mounting arm that is movable with respect to the upright. The pad mounting arm contains features, such as slots, for enabling the recoil pad to be removably attached to the pad mounting arm. For example, screws used to mount the recoil pad to the butt end of the firearm pass through the slots on the mounting arm. The screws are retained in place by suitable fasteners, e.g., nylon wing nuts.

The upright and pad mounting arm take the form of elongate, straight elements. They are adjustable, i.e., moveable, relative to each other to form an angle measuring or capturing feature. In use, the upright is placed flush against the butt and the pad mounting arm is placed flush against an adjacent top (or toe) surface of the gunstock. The upright and pad mounting arm define an included angle $\alpha$ therebetween matching the gunstock angle when they are in the adjusted, stock-fitting position. A fastener is provided for retaining the upright and pad mounting arm securely in the adjusted, stock-fitting position. A support block engages the upright below the pad mounting arm, and is provided to support the pad mounting arm in the adjusted position relative to the upright. The support block enables longitudinal movement and adjustment of the pad mounting arm relative to the base, for reasons which will become more clear hereafter, without losing the angle adjustment captured by the upright and pad mounting arm.

At the time of use of the jig, the outline of the butt end of the gunstock is scribed onto the mounting surface of the recoil pad. After the pad support arm and upright are secured in the adjusted position, the recoil pad is attached to the pad mounting arm in an upside down configuration. The jig, with attached recoil pad, is then moved against a vertically-oriented grinding or sanding instrument such as a sanding disk or belt. The action of the grinding or sanding instrument ablates the recoil pad. The operator removes material from the recoil pad up to the edge of the scribed line. The particular angular position that the jig holds the recoil pad in results in the recoil pad being ground or sanded in a manner such that the recoil pad has a contour that fits substantially flush with the butt end and top (or toe) surfaces of the gunstock.

In use, the jig is used to grind or sand the top of the recoil pad in the area corresponding to the top of the stock, and in the adjacent area, such as for approximately one-third the length of the pad. Then the pad is removed from the jig. The upright and pad mounting arm are then readjusted by fitting them flush against the butt and toe portions of the gunstock, respectively, and then secured in the new adjusted position. The pad is then re-attached to the pad mounting arm with the portion of the recoil pad corresponding to the toe facing the grinding or sanding instrument. The portion of the recoil pad corresponding to the toe of the gunstock is ground or sanded, along with the adjacent area, to just barely remove the scribed line. Finally, the sides of the recoil pad are ground to the scribed line, just barely removing the scribed line on the sides of the recoil pad.

The resulting recoil pad fits substantially flush with the butt, toe and top surfaces of the gunstock and has an excellent fit and finish. The jig is easy to use, does not require any unusual skill, and the jig and method of use does not risk damaging the finish of the gunstock. The pad mounting screws that secure the pad to the gunstock are used to mount the pad to the jig. Thus, the jig does not require a separate operation of removing the pad screws and using different screws to mount the pad to the jig, as in the B-Square Jig. Moreover, it is a very simple procedure to find the angle to grind the precise contours of the gunstock into the pad. When the process is complete, the lines of the stock project in a smooth and continuous fashion into the lines of the recoil pad, basically appearing as a continuation or extension of the lines of the gunstock. Moreover, the jig is simple to manufacture. As such, the jig, and method of use to form recoil pads, is believed to represent a significant advance in the art.

A method of grinding a generic recoil pad with the aid of a grinding jig is also described. The grinding jig comprises a base, an upright and a pad mounting arm. The method comprises the steps of:

(1) placing the recoil pad against the butt end of the gunstock and scribing the outline of the butt end onto the recoil pad;

(2) manually adjusting the upright and pad mounting arm of the grinding jig such that they fit flush against the butt end and toe (or top) portion of the gunstock, respectively, and securing the upright and pad mounting arm in that adjusted position;

(3) mounting the recoil pad to the pad mounting arm with the pad mounting arm in the adjusted position; and (4) manually manipulating the grinding jig with the pad mounted thereto against a sanding or grinding instrument to ablate a portion of the recoil pad in the area corresponding to the toe (or top) portion of the gunstock, whereby the recoil pad has a surface configuration substantially matching the surface configuration the toe (or top) and butt of the gunstock. In yet another aspect, the invention relates to a recoil pad manufactured in accordance with the above-described method.

These and other features and advantages of the invention will be more apparent from the following detailed description and appended drawings.

DETAILED DESCRIPTION OF THE PREFERRED EMBODIMENT

Figure 1:
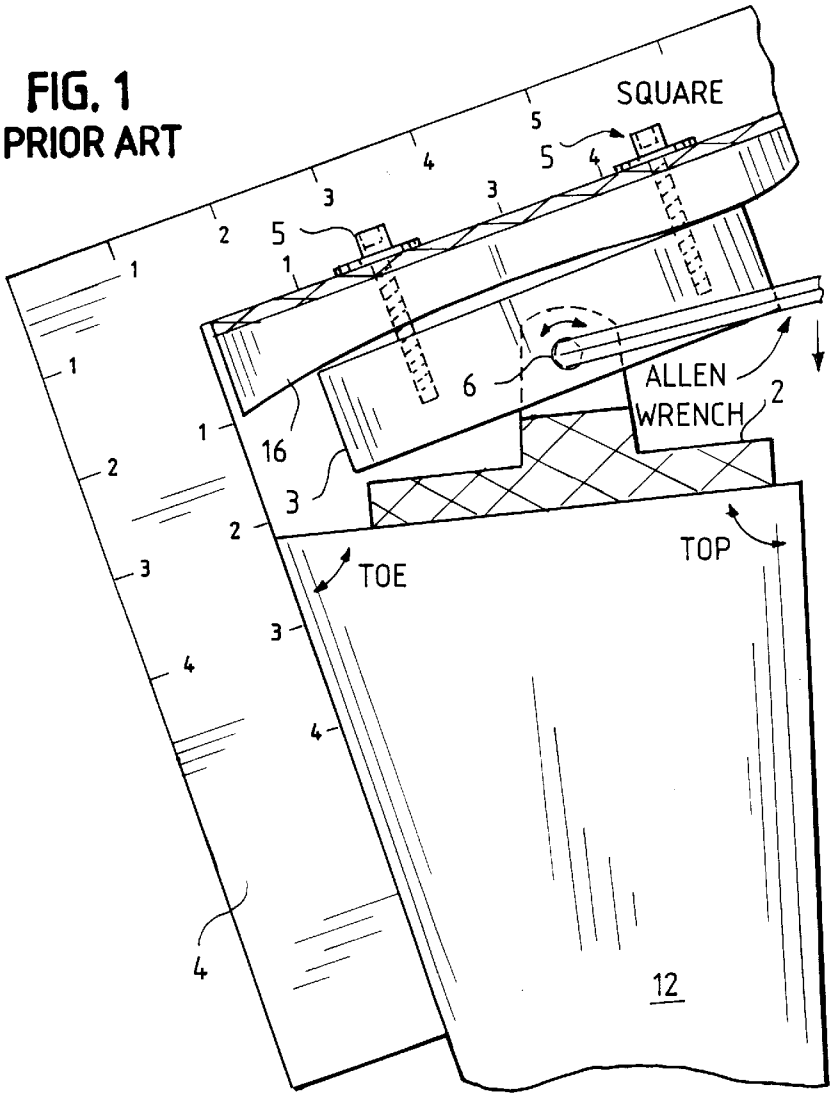
FIG. 1 PRIOR ART
FIG. 1 is an illustration of a prior art B-Square jig for grinding recoil pads, shown in a side view with a square used to capture the toe angle of the gunstock with a pad attached to the jig.
Figure 1A:
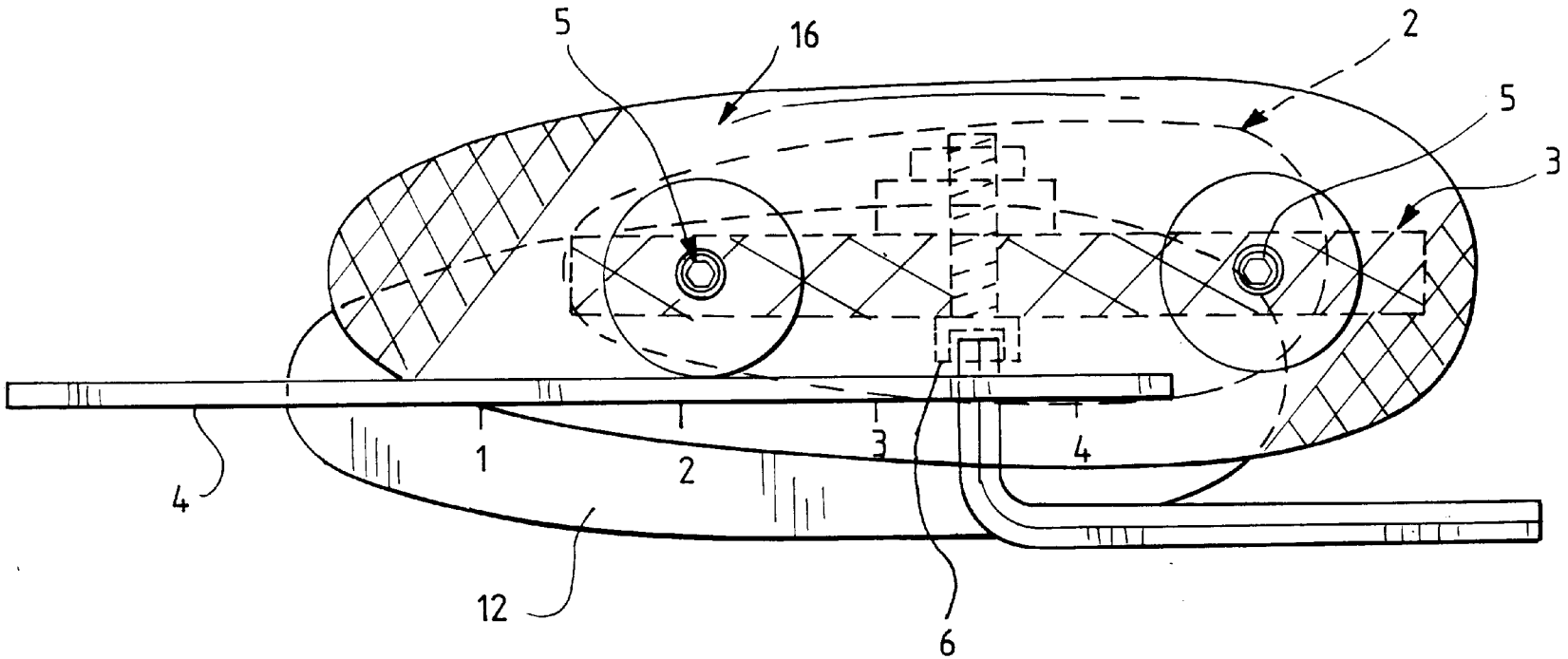
FIG. 1A is a top view of the pad and jig of FIG. 1.
Figure 2:
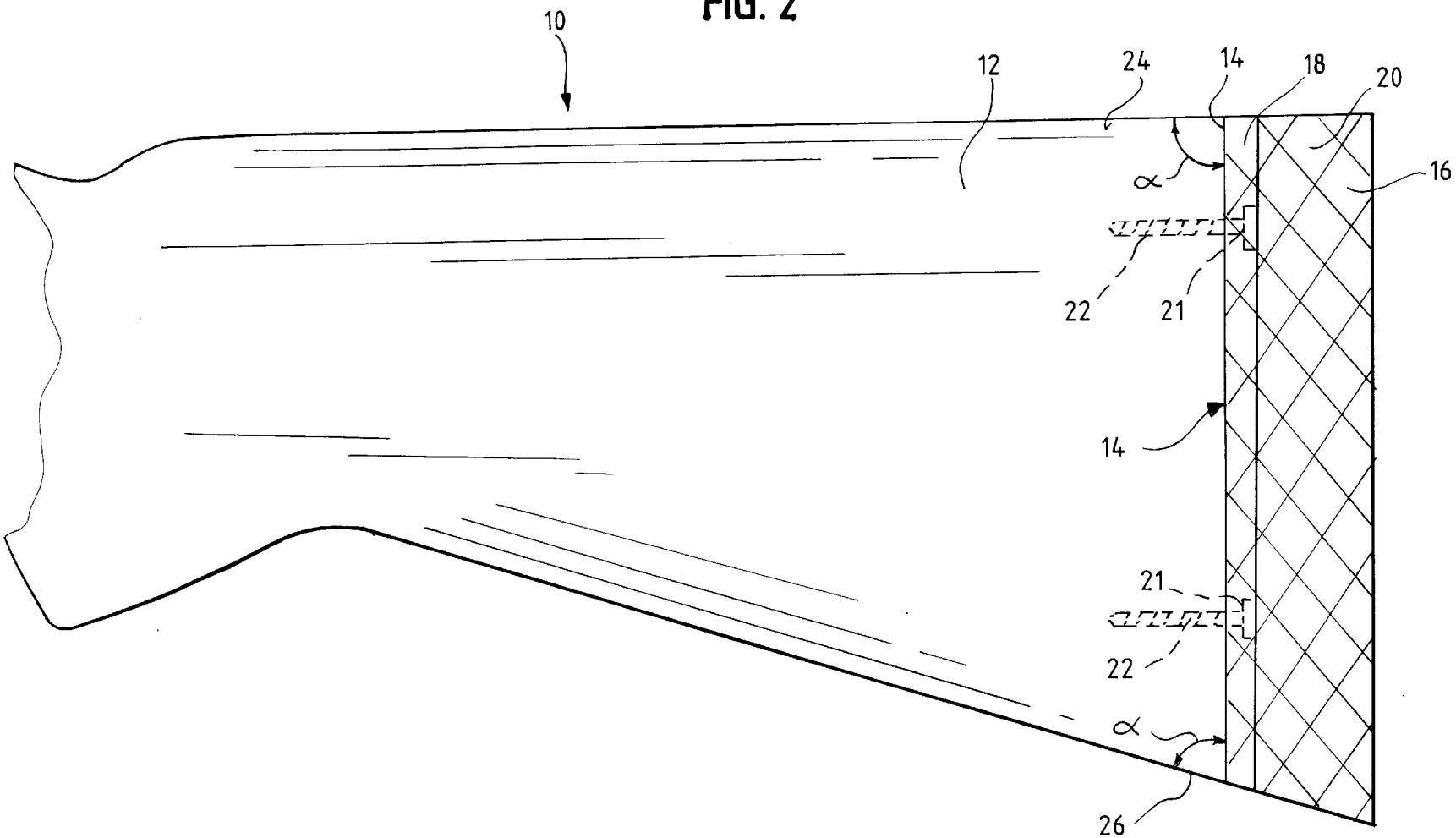
FIG. 2 is an elevational view of a gunstock of a firearm having a recoil pad fitted to the butt end thereof, in which the recoil pad fits flush with the butt, top and toe surfaces of the gunstock to make an excellent and aesthetically pleasing fit with the gunstock in accordance with the invention.

Referring now to FIG. 2, a firearm 10 is shown having a gunstock 12 and a butt end 14. A recoil pad 16 having a hard rubber region 18 and a resilient, shock absorbing rubber portion 20 is mounted to the butt 14 via two mounting screws 21 that extend from the hard rubber region 18 into corresponding apertures 22 provided in the stock 12, as shown. A slit is formed in the top of the recoil pad in registry with the screw holes provided in the base of the pad, and the screws 21 are fully inserted into the pad so that the head of the screws 21 seat on the hard rubber region 18. A screwdriver is inserted into the slit allowing the screws 21 to be fastened to the butt 14 as shown.

The gunstock 12 includes a sharply curved top portion 24 and a sharply curved toe portion 26. The jig of the present invention enables generic, oversized recoil pads to be ground or sanded down to custom fit the contours of the gunstock 12 prior to mounting the pad 16 to the gunstock 12. Therefore, there is no risk of marring the finish of the gunstock (e.g., where the pad is mounted to the gunstock and then the pad is ground or sanded down). Note that the top and toe portions 24 and 26, respectively, have a flush and aesthetically pleasing fit with complete continuity with the recoil pad 16 as shown in FIG. 2.

As is described below in conjunction with FIGS. 12 and 13, the top portion 24 and the toe portion 26 make an included angle relative to the surface of the butt 14, these angles illustrated as angle $\alpha$ in FIG. 2. In FIG. 2, the top angle is about 90 degrees and the toe angle is about 75–80 degrees in the illustrated embodiment, but will vary. These angles are measured by an angle finding feature in the jig of the present invention and used to give the recoil pad the proper shape and configuration as indicated in FIG. 2.

Jig Construction

Figure 3:
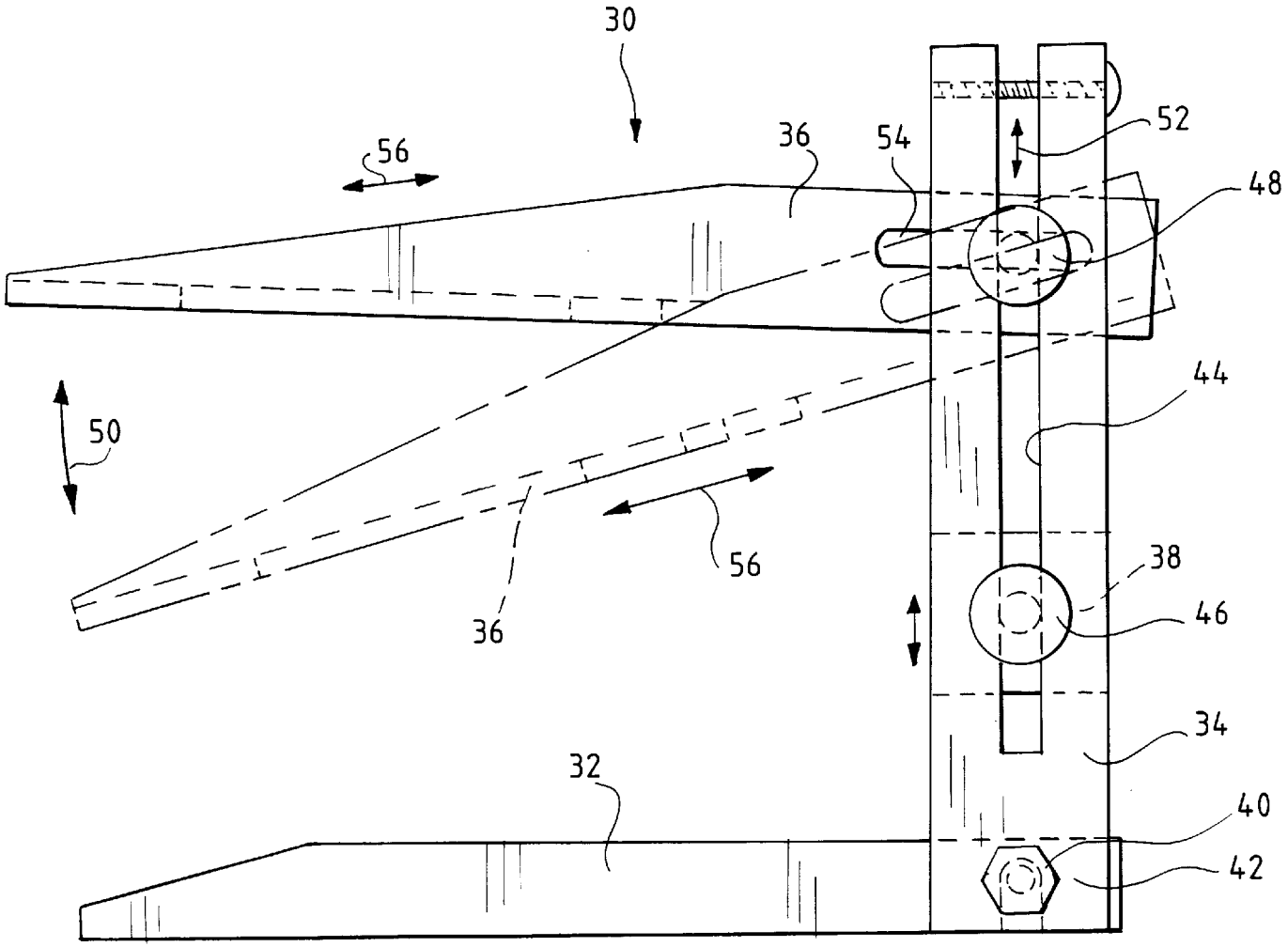
FIG. 3 is an elevational view of a grinding jig in accordance with a preferred embodiment of the invention, showing the pivoting movement of the recoil pad mounting arm relative to the upright, a measurement feature used as described in more detail herein.

A presently preferred embodiment of the jig of the invention is shown in FIG. 3 in an elevational view. The jig 30 includes a base 32, an upright 34 extending perpendicular from the base, and a pad mounting arm 36. The preferred embodiment also includes a support block 38, which is moveable relative to the upright 34. The jig 30 is made of a suitable rigid material, such as, for example, machined aluminum alloy. The components of the jig are shown in FIGS. 4A–9, and reference should also be made to these figures in the following discussion.

The base 32 provides a flat surface to support the jig on a work surface associated with a grinding or sanding instrument. A hex bolt 40 is used to fasten the bottom portion 42 of the upright 34 to the end of the base 32 as shown. In the preferred embodiment, the upright is removable from the base by loosening the bolt 40 to facilitate ease of use of the angle finding feature of the jig, described below in further detail. Alternatively, the base could be constructed such that the base 32 pivots or swings away from the upright 34 to facilitate use of the angle finding feature.

Figure 8B:
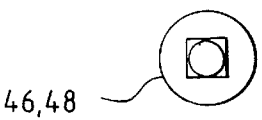
FIGS. 8A–8C are views of a bolt of the type that is used to fasten the recoil pad mounting arm and the support block to the upright in FIG. 3.
Figure 8A:
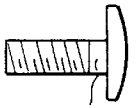
Figure 8C:
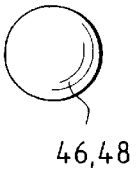
Figure 14B:
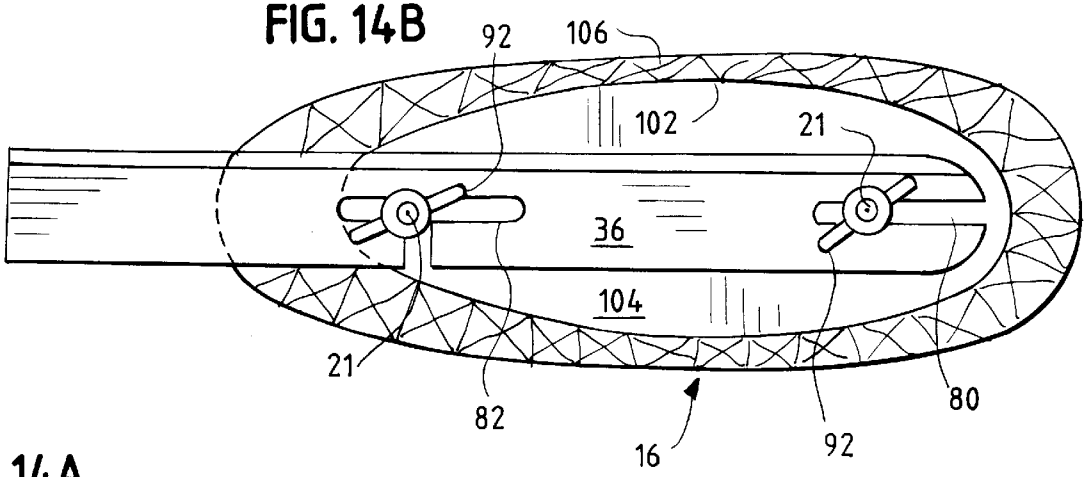
FIGS. 14A and 14B are elevational and top views, respectively, of the jig of the present invention with a generic recoil pad mounted to the pad mounting arm, with the mounting arm and upright secured relative to one another in the position shown in FIG. 12.
Figure 14A:
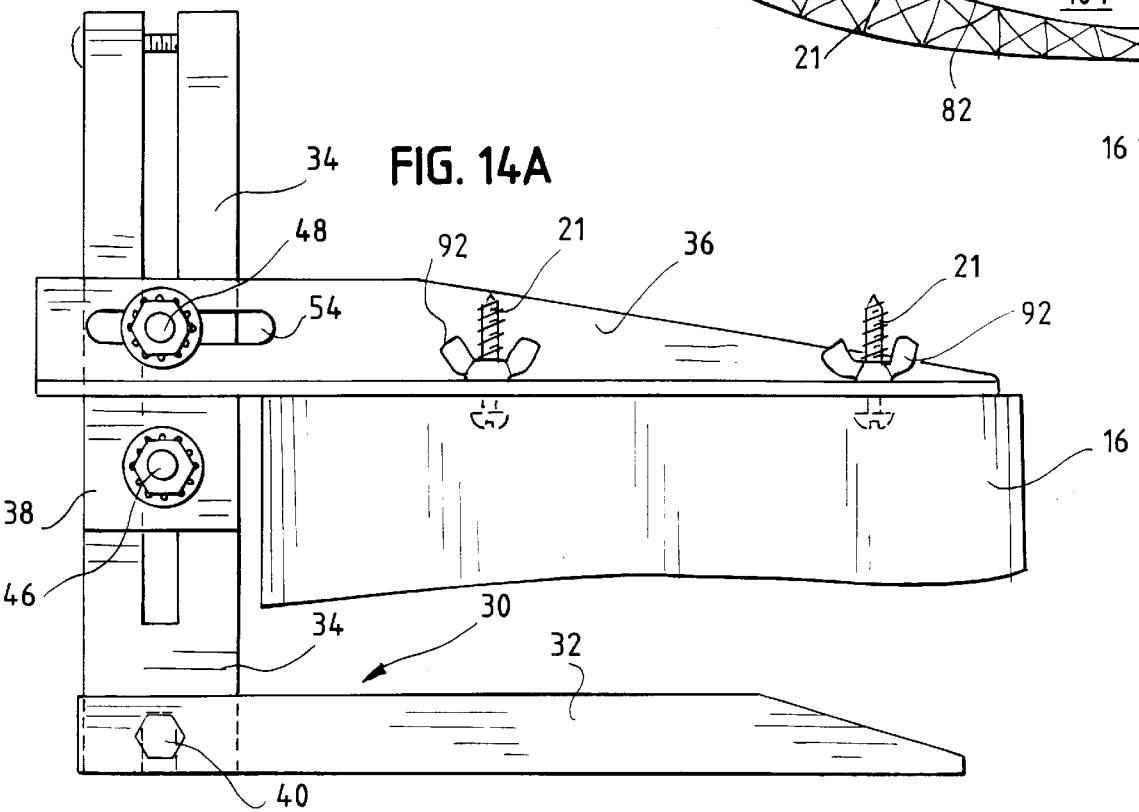
Figures 17A, 17B:
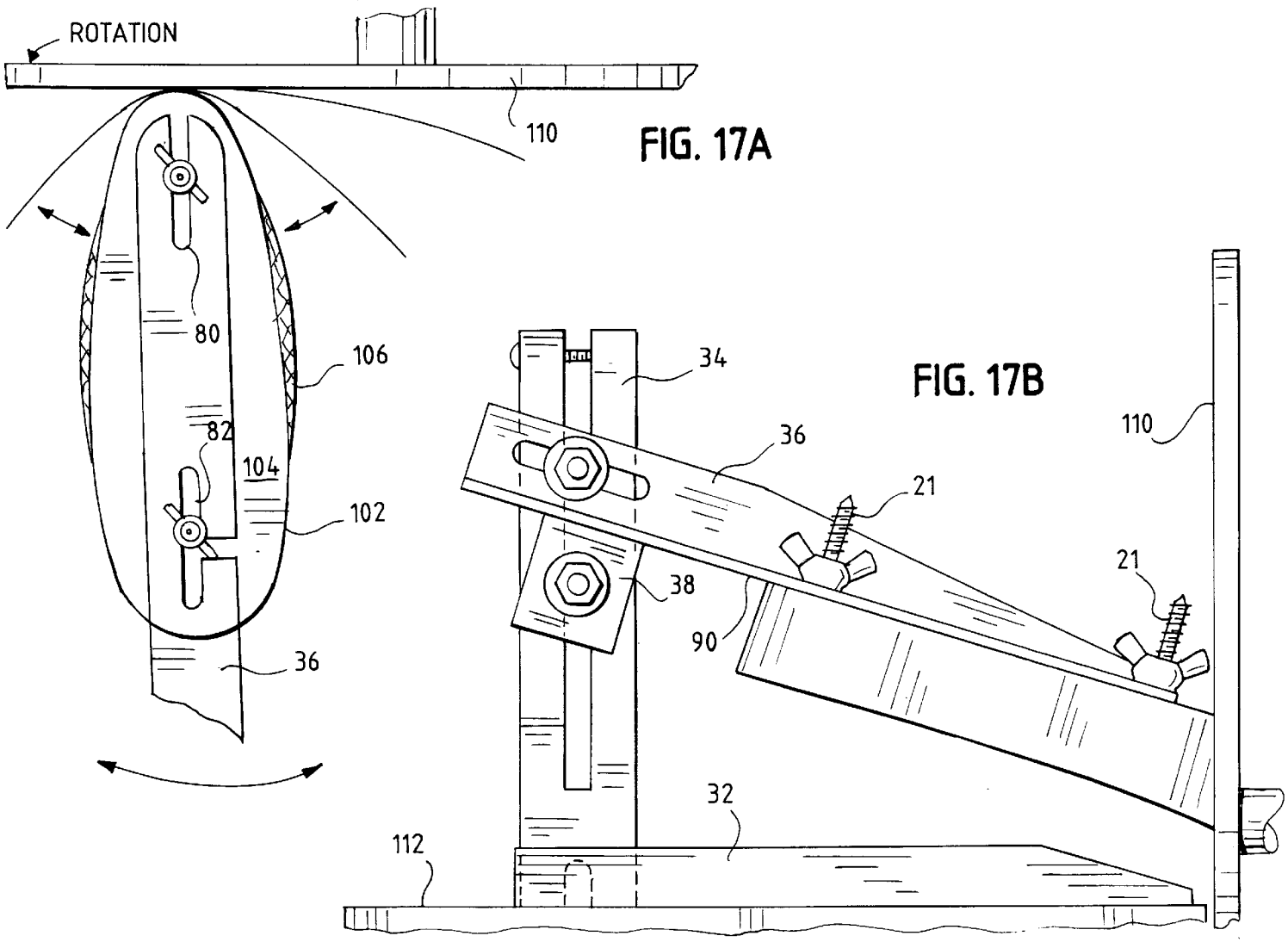
FIGS. 17A and 17B are top and elevational views, respectively, of the grinding jig with attached recoil pad being sanded by a sanding or grinding instrument to ablate material from the recoil pad in the portion of the pad corresponding to the toe of the gunstock, and along approximately one third of the length of the recoil pad towards the top portion thereof.

The upright 34 has a body portion forming an elongate central slot 44. A fastener 46 such as shown in FIGS. 8A–8C extends through the slot 44 and secures support block 38 to the rear surface of the upright 34. Likewise, a nut for the fastener 46 can be loosened to allow the support block to move up and down in the slot 44 or be rotated about the axis of the fastener to be placed into supporting engagement with the pad mounting arm 36, such as shown in FIG. 14A or FIG. 17B.

The slot 44 also provides a means by which another fastener 48 (and associated nut) secures the pad mounting arm 36 to the upright 34. By loosening the nut for the fastener 48, the pad mounting arm can be moved to a multitude of positions relative to the upright. The pad mounting arm is secured in a measurement or adjustment position (as described below) by simply tightening the nut for the fastener 48. In FIG. 3, the action of moving the pad mounting arm relative to the upright is indicated by the position of the pad mounting arm in dashed lines and the arrows 50 and 52. Furthermore, the pad mounting arm has a slot 54 which, together with the fastener 48, enables the pad mounting arm 36 to move back and forth in a longitudinal manner relative to the upright 34 as indicated by the arrow 56 and locked in place.

Figure 4B:
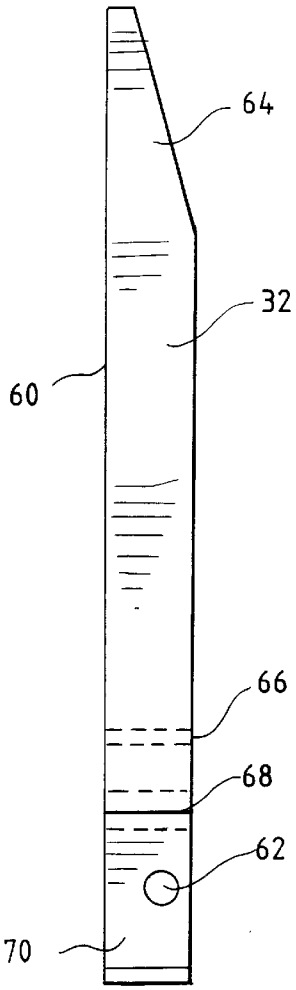
FIGS. 4A–4B are top and side views, respectively, of the base of the grinding jig of FIG. 3.
Figure 4A:
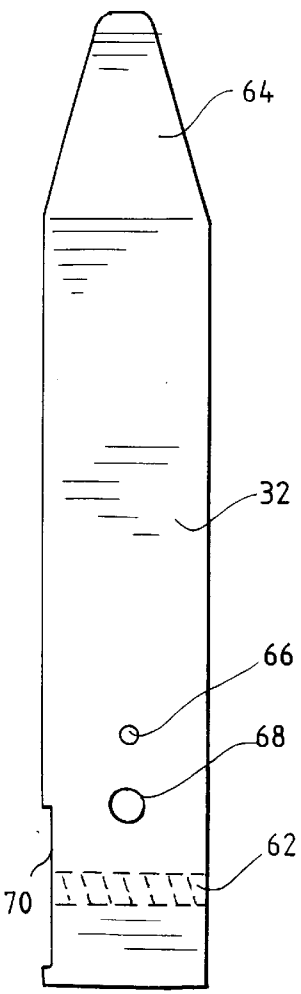

The base 32 is shown in a top view in FIG. 4A and in a side view in FIG. 4B. The base 32 is an elongate planar member having a flat lower surface 60 that rests on the work surface and a toe portion 64. The toe portion 64 has a tapered shape allowing the recoil pad to be positioned proximate to the grinding or sanding instrument, as will be appreciated from FIGS. 15–17 and the following discussion. FIGS. 4A and 4B show the hole 62 tapped to receive the fastener 40 of FIG. 3. The base is also used to facilitate the drilling of the screw holes 22 of FIG. 2. The base includes a drill guide hole 66 for keeping a drill bit at a 90 degree angle when the pad screw holes 22 (FIG. 2) are drilled into the gunstock. Also, a guide hole 68 is provided for guiding a drill bit for a dowel piece to fill in an existing screw hole in the gunstock which may not coincide with the new pad screw holes. The base 32 also includes a slight recess 70 that receives the recessed bottom portion 42 of the upright at shown in FIG. 3 and 5A. This feature allows the upright 34 to be positioned absolutely perpendicular to the base and locked in place.

Figure 5A:
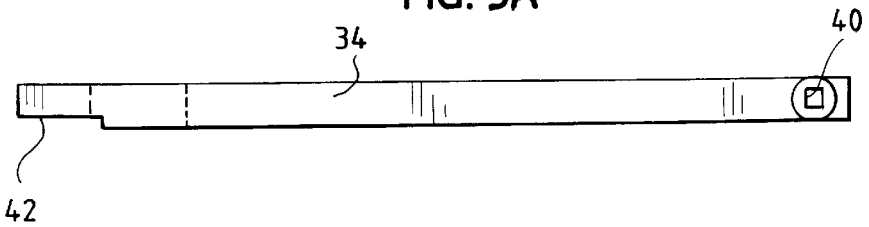
FIGS. 5A–5C are a series of views of the upright of the grinding jig of FIG. 3.
Figure 5B:
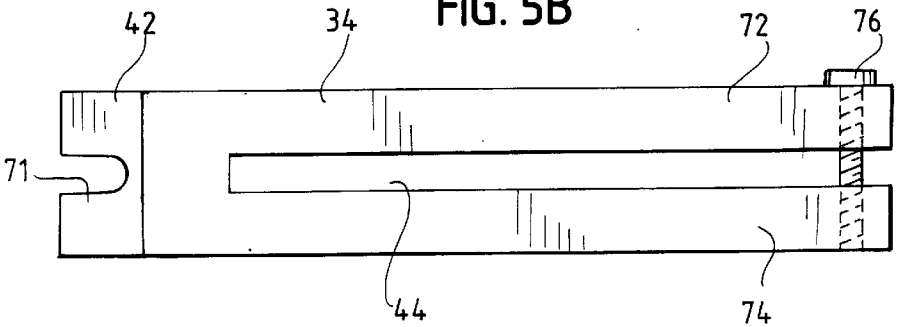
Figure 5C:
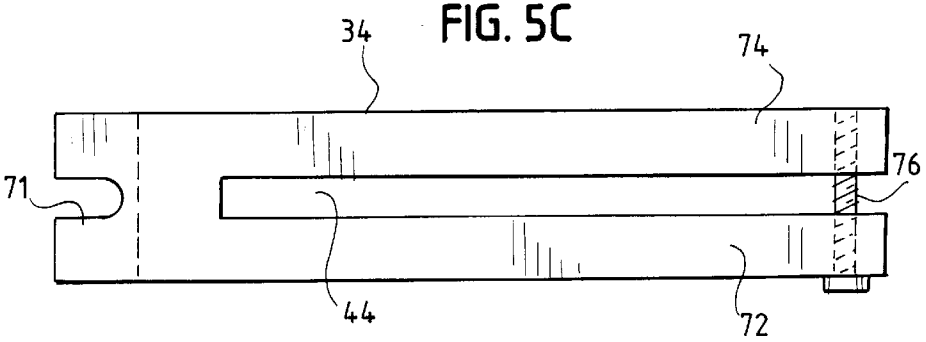

The upright 34 is shown in a side view in FIG. 5A, a front elevational view in FIG. 5B and in a rear elevational view in FIG. 5C. The upright includes the bottom portion 42, a U-shaped channel 71 that fits over the fastener 40 of FIG. 3, and a pair of opposed forks 72 and 74 that define the slot 44 of FIG. 3. The ends of the forks 72 are secured together by means of a suitable fastener 76 passing through apertures in the forks. In the preferred embodiment, the hole for the fastener 76 is drilled and the fastener 76 is used to tap the hole, and then removed. The slot 44 is then formed in the upright. Then, the fastener 76 is reinserted into the hole. Because the threads were already formed, the installation of the fastener 76 does not tend to bend the two forks together.

Figure 6C:
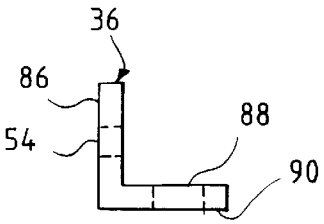
FIGS. 6A–6C are top, side and end views, respectively, of the recoil pad mounting arm of FIG. 3.
Figure 6B:
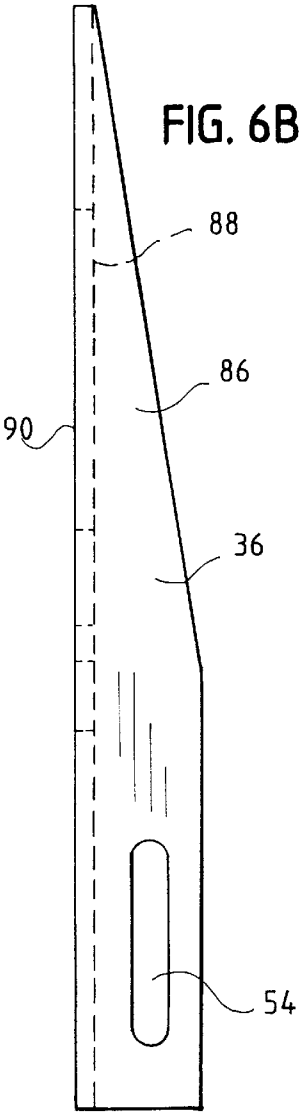
Figure 6A:
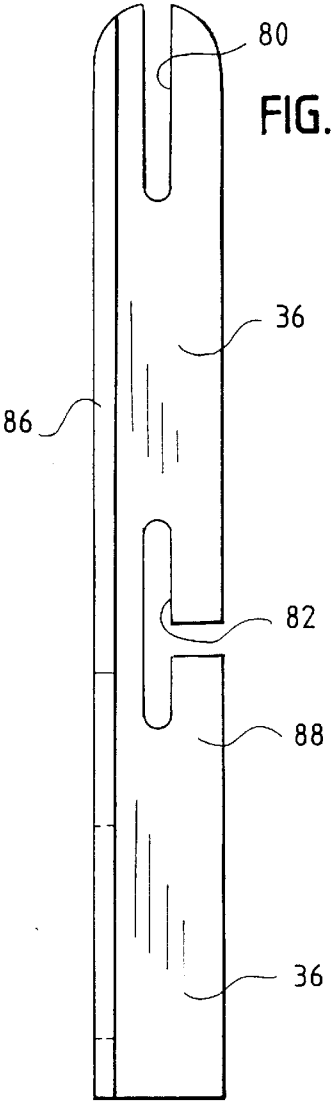
Figures 15A, 15B:
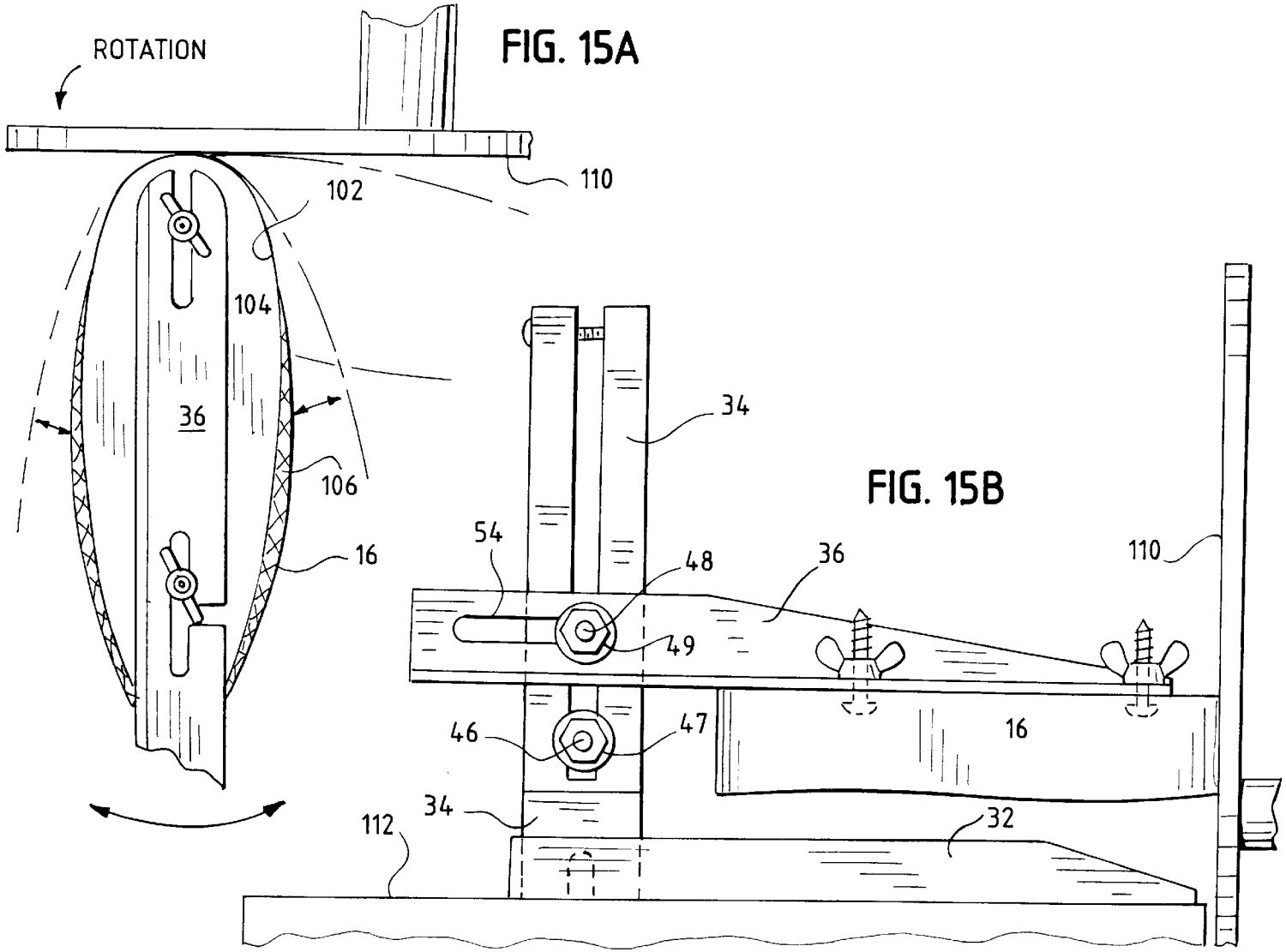
FIGS. 15A and 15B are top and elevational views, respectively, of the grinding jig with attached recoil pad being sanded by a sanding or grinding instrument to ablate material from the recoil pad in the portion of the pad corresponding to the top of the stock, and along approximately one third of the length of the recoil pad towards the toe portion thereof.

The pad mounting arm 36 of FIG. 3 is shown isolated in a top plan view of FIG. 6A, in a side elevational view in FIG. 6B and in an end view in FIG. 6C. The pad mounting arm includes features for enabling a recoil pad to be removably attached to the pad mounting arm. In the illustrated embodiment, a pair of slots 80 and 82 are provided which receive the screws 21 that retain the pad to the gunstock. The screws 21 are clamped to the pad mounting arm 36 by means of plastic wing nuts 92 or other suitable device in the manner shown in FIGS. 14A and 14B. The pad mounting arm includes an upstanding flange 86 which has the slot 54 of FIG. 3 formed therein, thereby permitting the pad mounting arm to be movably and pivotably connected to the upright by means of the fastener 48. The elongate form of the slot 54 allows the pad mounting arm 36 to also be moved in a longitudinal fashion relative to the upright 34. The arm 36 also includes a flat planar base portion 88. The planar mounting surface 104 (FIG. 11) of the recoil pad is placed flush against the bottom surface 90 of the base portion 88 when the recoil pad is attached to the pad mounting arm, as shown in FIGS. 14B and 15A.

Figure 7B:
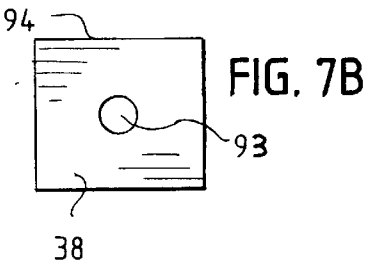
FIGS. 7A and 7B are two views of the support block of FIG. 3.
Figure 7A:
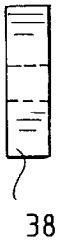
Figures 16, 16A:
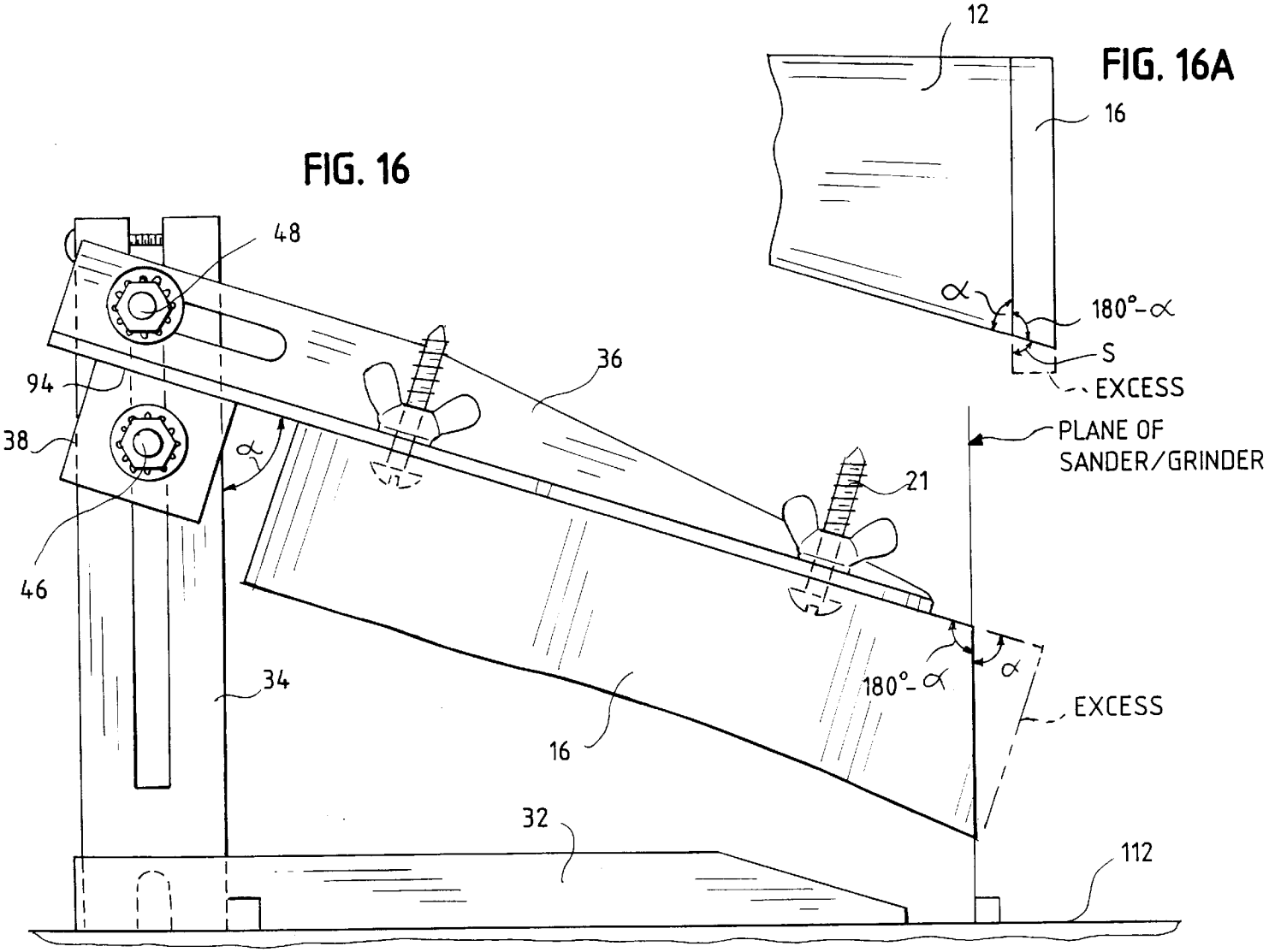
FIG. 16 is an elevational view of the grinding jig with attached recoil pad being sanded by a sanding instrument to ablate material from the recoil pad in the portion of the pad corresponding to the toe of the stock.
FIG. 16A shows the relationship between the angle $\alpha$, the gunstock and the recoil pad.

FIG. 7A is a side view of the support block 38 of FIG. 3. The support block 38 consists of at least one linear or planar side edge 94 which is used to support the pad mounting arm 36 when the pad is being ground, as shown in FIG. 16. The support block 38 includes an aperture 93 for receiving a suitable fastener such as the bolt 46 shown in FIGS. 8A–8C, enabling the support block to be secured to the forks of the upright 34. Loosening the bolt 46 allows the support block 38 to slide out of the way when the angle finding feature is being used.

Figure 9:
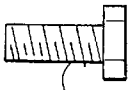
FIG. 9 is an elevational view of a hex bolt used to fasten the upright to the base of FIG. 2.

In view of the aluminum material chosen for the jig in the illustrated embodiment, to help the support block 38 and the pad mounting arm to be securely fastened to the upright 34, a lock nut or lock washer is used in conjunction with the bolts 46 and 48 of FIGS. 3 and 8A–8C, and with bolt 40 of FIG. 9.

Figure 13:
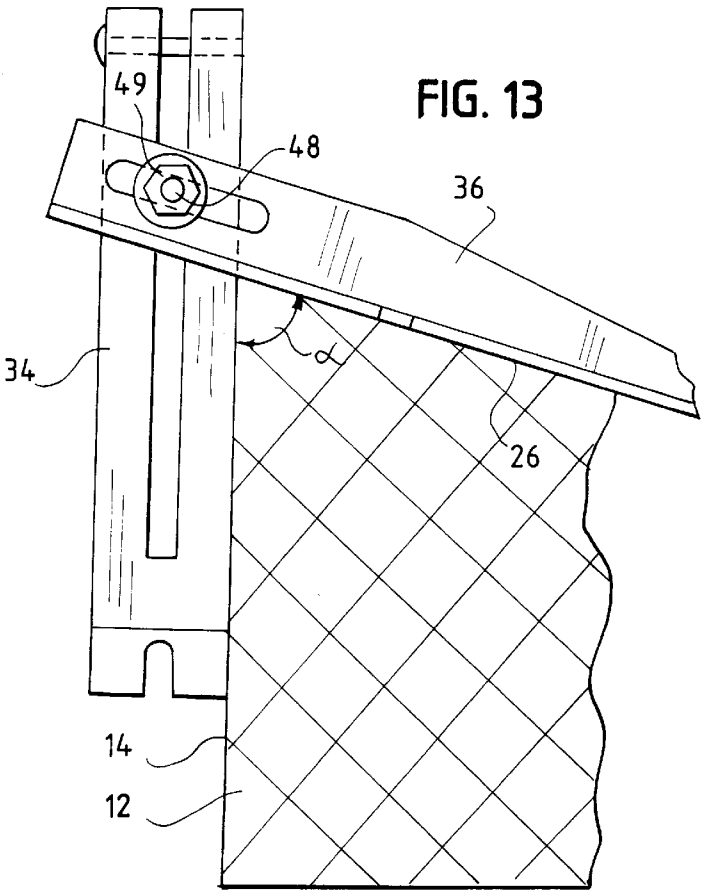
FIG. 13 is an illustration showing the placement of the upright and the recoil pad mounting arm against the butt and toe of the gunstock, with the upright and recoil pad mounting arm forming an included angle $\alpha$.
Figure 12:
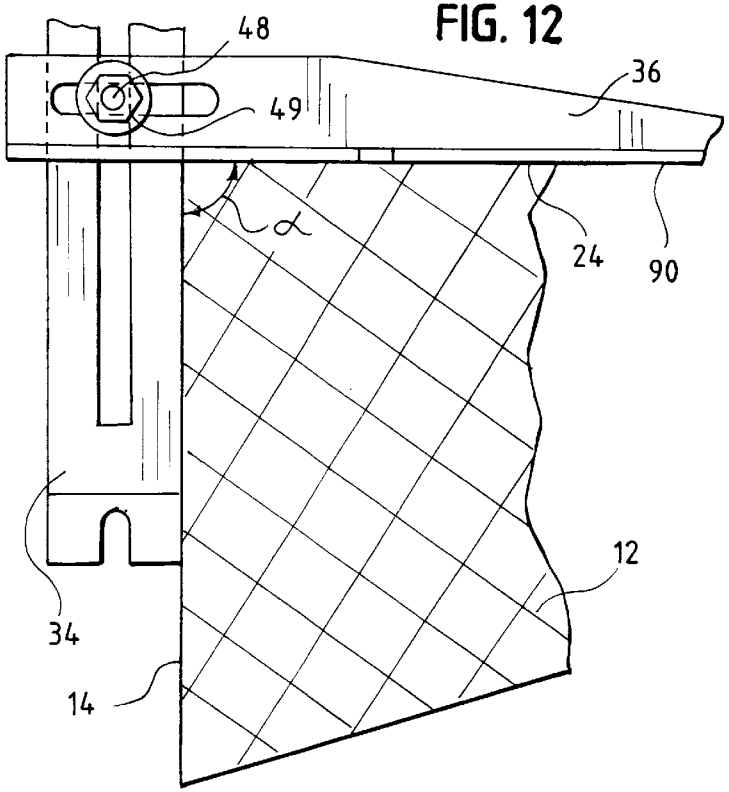
FIG. 12 is an illustration showing the placement of the upright and the recoil pad mounting arm against the butt and top of the gunstock, with the upright and recoil pad mounting arm forming an included angle $\alpha$.

As shown in FIGS. 3, 12, 13, 16 and explained further in the following discussion, the upright 34 and pad mounting arm 36 are adjustable relative to each other, and this relative movement is used as an angle measurement feature. As shown in FIGS. 12 and 13, the upright 34 fits flush against the butt 14 of the gunstock 12 and the top (and toe) surfaces 24 or 26 of the gunstock, respectively, to define or capture the included angle α. After capturing this angle, the pad mounting arm is secured in place in the adjusted position and the support block brought into place. The recoil pad is then mounted to the bottom surface of the pad mounting arm 36 in an upside down configuration and the recoil pad sanded or ground as described in the following discussion. This ability to capture the include angle α and use that angle when the pad is mounted to the pad mounting arm 36 allows the pad to be shaped to fit substantially flush with the top and toe features of the gunstock.

Method of Use

Figure 10:
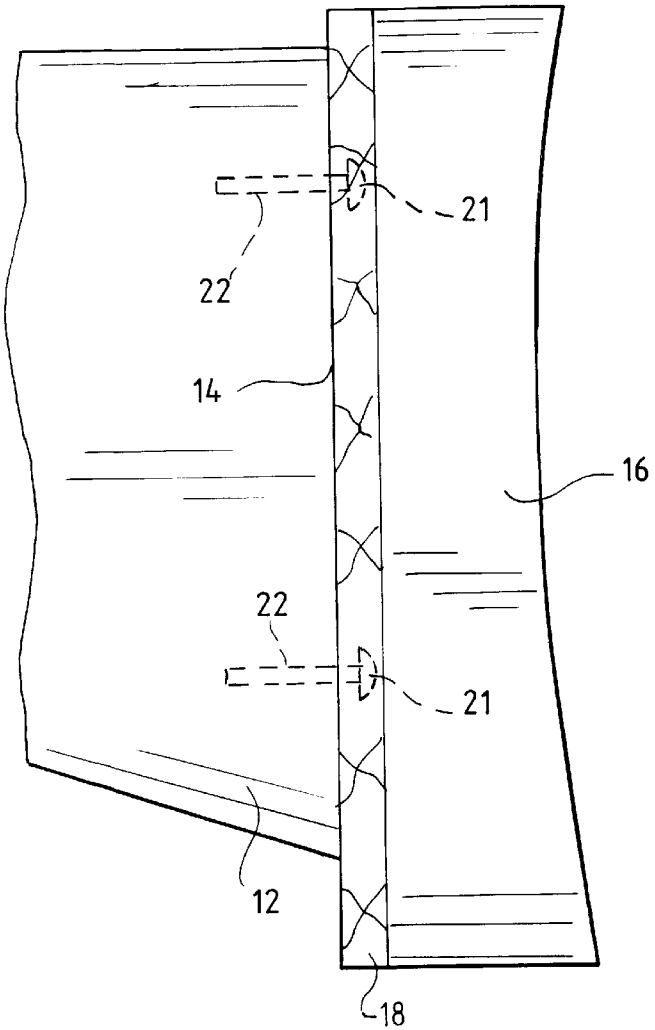
FIG. 10 is an elevational view of a generic recoil pad fastened to the gunstock of a firearm as it would be when the perimeter of the butt end of the gunstock is traced onto the recoil pad as an initial step in the method of the invention.

With the above description of the jig per se in mind, the manner of using the jig will be now be discussed with reference to FIGS. 10–18. First, the length of the gunstock is shortened by an amount equal to the thickness of the recoil pad so as to maintain the same length of trigger pull as before the pad is installed. Therefore, the end of the stock is cut off and one begins by mounting a new, oversized generic pad 16 onto the gunstock butt end 14 as shown in FIG. 10. The base 32 of the jig has a drill guide hole 66 (FIG. 4A) for keeping the pad screw drill bit perfectly perpendicular to the butt 14 when the new mounting holes 22 are drilled into the gunstock 12. If needed, previous holes that may need to be filled with a dowel are drilled out using the hole 68 in the base 32 as a guide.

Figure 11:
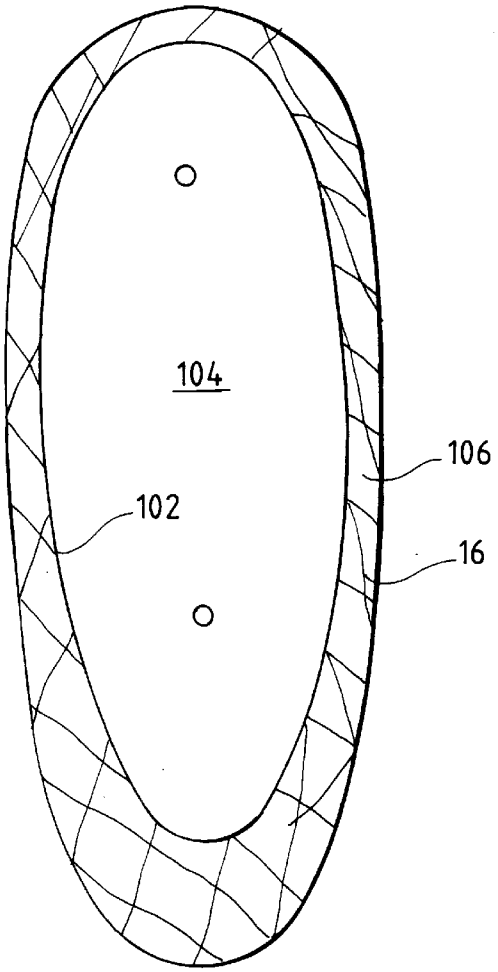
FIG. 11 is a plan view showing the generic recoil pad with the trace of the butt scribed on the surface of the recoil pad, with the portion to be removed via ablation shown in hatched lines.

After the new pad is mounted to the butt as shown in FIG. 10, a very sharp scriber is used to scribe the outline of the butt 14 onto the hard rubber flat portion of the pad as shown in FIG. 11. The pad is then removed from gunstock, and one can clearly see the outline 102 scribed on the pad's flat mounting surface 104. The excess to be removed is indicated at 106. Rubbing some white chalk into the scribe line 102 helps in seeing the line against the black background of the pad.

One next proceeds to set the angle of the top of the stock with the angle finding feature of the jig, as shown in FIG. 12. Ordinarily, the base is removed or pivoted out of the way from the upright in this operation. The edge of the upright 34 is placed against the surface of the butt 14 and the bottom surface 90 of the pad mounting arm 36 is placed flush against the top portion 24 of the gunstock, thereby capturing or securing the included angle α, as shown in FIG. 12. The nut 49 for fastener 48 is tightened firmly to maintain the pad mounting arm and upright in the adjusted position shown in FIG. 12. The upright 34 and pad mounting arm 36 are then removed from engagement with the gunstock. The support block 38 is moved into position under the pad mounting arm 36, and then the support block's nut is firmly tightened.

Next, the new pad is mounted to the pad mounting arm 36. With reference to FIGS. 14A and 14B, the mounting screws 21 with nylon wing nuts 92 are maneuvered into the slots 80 and 82 in the pad mounting arm 36 and the wing nuts 92 are tightened. As shown in FIG. 14B, care is taken to insure that the pad 16 is positioned relative to the pad mounting arm such that the perimeter of the pad mounting arm 36 is completely within the scribed line 102 on the pad. The region 106 of the pad outward from the scribe line 102 is to be removed during the grinding operation. The pad is installed such that the portion of the pad corresponding to (i.e. matching up with) the top portion of the gunstock is facing away from the upright 34 and toward the grinding or sanding instrument. The slots 80 and 82 in the arm allow the pad screws to adjust laterally as may be needed.

Next, the assembly of the upright 34 and recoil pad mounting arm/pad is secured to the base 32 via the hex bolt 40.

Next, one then adjusts the pad mounting arm 36 laterally in the slot 54 to minimize overhang of the pad beyond the toe portion of the base 32. The resulting configuration of the jig and pad should look like that shown in FIG. 14A.

Figure 19:
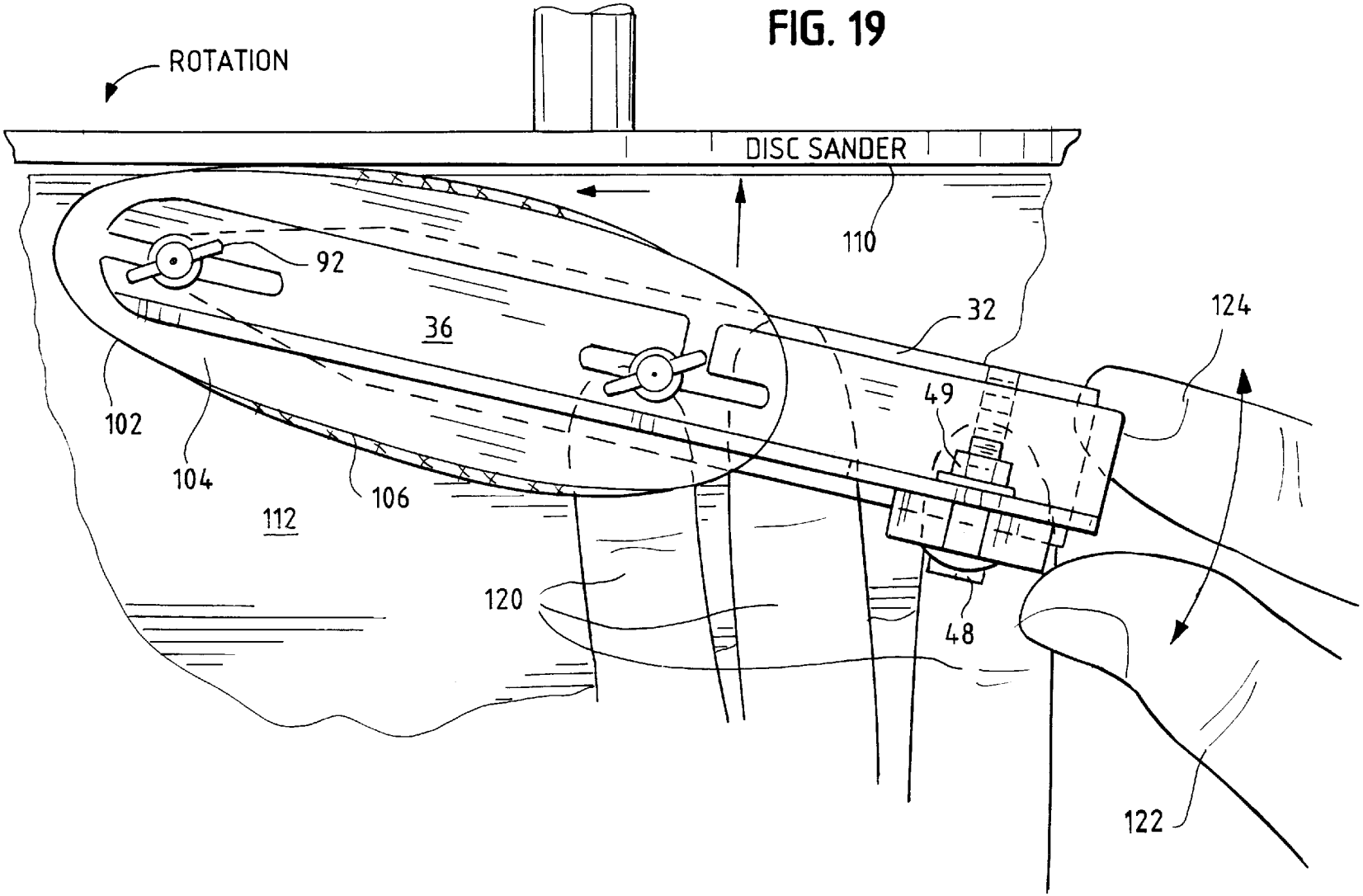
FIG. 19 shows the position of the operator's fingers when the grinding jig of FIG. 3 is used against a vertically oriented grinding or sanding instrument.

A vertically oriented disc sander or belt sander 110 is then used to grind away the excess portion of the pad as shown in FIGS. 15A and 15B. The table 112 of the sanding or grinding instrument 110 must be at 90 degrees to the disc or belt in order for the angles of the stock to be carried correctly to the finished pad. The operator grinds away the excess carefully until the scribe line 102 is just barely removed, using a left-right sweeping motion, all the while maintaining finger pressure on the base as shown in FIG. 19, and using the thumb and index finger to grasp the upright piece 34. At this step, the operator works down about one third of the way on each side of the pad.

The next step is to loosen the bolt securing the upright to the base, loosen the pad mounting wing nuts, remove the pad 16 from the arm 36, and loosen the lock nuts 47 and 49 for the support block 38 and the pad mounting arm 36. The support block 38 is slid down the slot 44 out of the way.

The operator then captures the angle α of the toe of the stock with the upright and pad mounting arm as shown in FIG. 13. The lock nut 49 is tightened, and the support block 38 is moved to a supporting position below the pad mounting arm 38 and its lock nut 47 tightened. The pad 16 is then mounted to the surface 90 of the pad mounting arm via the wing nuts 92 and the wing nuts are tightened. The operator checks the lateral position of the pad 16 relative to the arm 36 to insure that the tip of the arm 36 is completely within the scribe line 102. The operator then reassembles the upright 34 to the base 32 via the hex bolt 40. Overhang of the pad 16 relative to the base is adjusted by means of the bolt 48 and the slot 54, if necessary. The resulting configuration should look like that shown in FIG. 17B.

Figure 18:
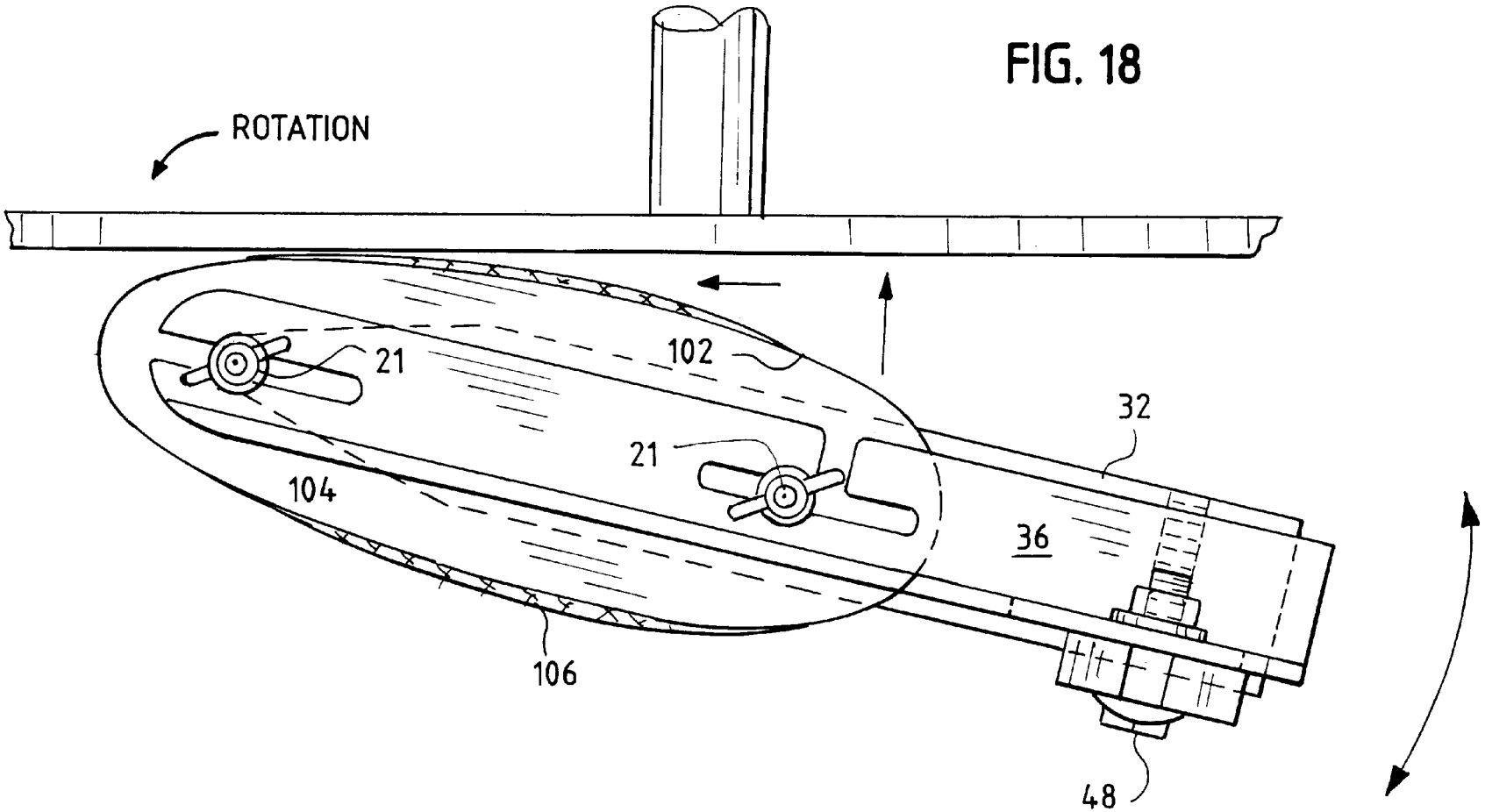
FIG. 18 is a top view showing the orientation of the jig and recoil pad relative to the grinding or sanding instrument to ablate the sides of the recoil pad.

The operator then proceeds to grind the toe portion of the pad with the same careful back and forth grinding as indicated in FIGS. 17A and 17B, removing the excess slightly beyond the scribe line 102 in the toe portion and the adjacent sides, about one third of the way down the length of the pad. Then, one turns the jig relative to the grinding or sanding instrument to remove the excess in the middle third of the pad as shown in FIG. 18, just barely removing the scribe line 102.

With the pad held in the particular angle illustrated in FIG. 17B, the edge of the pad will have a shape to fit substantially flush with the toe portion of the gunstock and give the appearance shown in FIG. 2. FIGS. 16 and 16A show the relevant geometrical parameters. The included angle of the gunstock a is captured by the upright and pad mounting arm 36. As shown in FIG. 16A, the pad needs to have an angle formed in the edge equal to $180°-\alpha$. This means that the portion of the pad to be removed must also have an angle $\alpha$, since opposite angles from two intersecting straight lines are equal. Thus, the pad must be ground such that angle $\alpha$ is formed by the grinding or sanding instrument, and this is insured since the both the plane of the sander surface and the upright 34 are orthogonal to the base 32, as indicated in FIG. 16.

Another incidental benefit of the orientation shown in FIGS. 16 and 17B is that the pad surfaces adjacent to the toe portion are also slightly flared, also fitting nicely with the flared surface of the gunstock adjacent to the butt. No special operator technique is needed to achieve this slight flare, rather, the operator simply nudges the pad against the surface of the sanding or grinding instrument, keeping base firmly against the support table 112, and the flair results as a consequence of the geometry of the configuration shown in FIGS. 17A and 177B. Even more flare can be obtained by inclining the base 32 slightly, such as by shimming one side of the base. FIG. 19 shows the placement of the operator's fingers on the jig during the grinding operation. The fingers 120 of the left hand hold the base 32 firmly against the worktable 112, while the thumb and forefinger 122, 124 of the right hand grasp the upright 32 and rotate the jig left and right against the surface of the grinding instrument 110.

From the above description, it will be apparent that a method has been described for grinding a generic recoil pad with the aid of a grinding jig. The method comprises the steps of:

(1) placing the recoil pad against the butt end of the firearm and scribing the outline of the butt onto the recoil pad;

(2) manually adjusting the upright and pad mounting arm of the grinding jig such that they fit flush against the butt and toe (or top) portion of the stock, respectively, and securing the upright and pad mounting arm in that adjusted position;

(3) mounting the recoil pad to the pad mounting arm with the pad mounting arm in the adjusted position; and (4) manually manipulating the grinding jig with the pad mounted thereto against a sanding or grinding instrument to ablate a portion of the recoil pad in the area corresponding to the toe (or top) portion of the gunstock. The recoil pad has a surface configuration substantially matching the surface configuration the toe (or top) of the gunstock.

Variations from the preferred embodiment of the jig are within the scope of the invention. For example, the details as to the shape, form or fastening features of the jig are not considered critical and can be varied without departure from the invention. This true scope and spirit of the invention will be determined by reference to the appended claims and equivalents thereof.

I claim:

1. A jig for grinding or sanding a recoil pad, comprising:

a base;

an upright extending perpendicular from said base; and a pad mounting arm movable with respect to said upright, said pad mounting arm containing a feature for enabling a recoil pad to be removably attached to said pad mounting arm;

said upright and pad mounting arm adjustable relative to each other so as to be able to fit flush against a butt end of a gunstock and an adjacent top or toe surface of said gunstock, respectively, to capture an included angle $\alpha$ therebetween in an adjusted, gunstock-fitting position;

said upright and pad mounting arm having a device retaining said upright and pad mounting arm securely in said adjusted position;

whereby when said recoil pad is attached to said pad mounting arm said pad may be ground or sanded by a vertically-oriented grinding or sanding instrument such that said recoil pad has a contour that fits substantially flush with said gunstock.

2. The jig of claim 1, further comprising a support block, said support block moveable with respect to said upright and said pad mounting arm to provide support to said pad mounting arm when said pad mounting arm is in said adjusted, gunstock-fitting position.

3. The jig of claim 1, wherein said upright and pad mounting arm are removable with respect to said base.

4. The jig of claim 1, wherein said base comprises an elongate planar member having a flat lower surface and a toe portion, said toe portion comprising a tapered shape.

5. The jig of claim 1, wherein said base further comprises a drill guide hole for a drill bit.

6. The jig of claim 1, wherein said base further comprises a drill guide hole for a dowel drill bit.

7. The jig of claim 1 wherein said pad mounting arm comprises an elongate slot for receiving said device securely retaining said upright and pad mounting arm, said elongate slot extending transversely along said pad mounting arm enabling longitudinal movement of said arm relative to said upright.

8. A jig for use in grinding or sanding an individual recoil pad, comprising:

a base;

an upright member detachable from said base and extending perpendicular from said base when said upright is attached to said base; and a pad mounting arm movable with respect to said upright, said pad mounting arm containing a feature for enabling a recoil pad to be removably attached to said pad mounting arm;

said upright and pad mounting arm adjustable relative to each other so as to be able to fit flush against a butt end of a gunstock and an adjacent top or toe surface of said gunstock, respectively, to capture an included angle $\alpha$ therebetween in an adjusted, gunstock-fitting position;

whereby when said recoil pad is attached to said pad mounting arm with said pad mounting arm fixed in said adjusted, gunstock-fitting position said pad may be positioned against a vertically-oriented grinding or sanding instrument and subject to ablation to a previously scribed outline matching the outline of said butt end resulting in a recoil pad having a contour that fits substantially flush with said surfaces of said gunstock.

9. The jig of claim 8, further comprising a support block, said support block moveable with respect to said upright and said pad mounting arm to provide support to said pad mounting arm when said pad mounting arm is in said adjusted, stock-fitting position.

10. The jig of claim 8, wherein said base comprises an elongate planar member having a flat lower surface adapted to fit flush on a level work surface and a toe portion, said toe portion comprising a tapered shape, the tapered shape allowing said recoil pad, when mounted to said pad mounting arm, to be positioned proximate to said grinding or sanding instrument.

11. A method of grinding a generic recoil pad with the aid of a grinding jig, said recoil pad for mounting to a butt of a gunstock, said recoil pad having a flat surface for fitting against said butt, said gunstock further comprising a toe portion and a top portion, and said grinding jig comprising a base, an upright and a pad mounting arm, the method comprising the steps of:

placing said flat surface of said recoil pad against said butt and scribing the outline of said butt onto said recoil pad;

manually adjusting said upright and pad mounting arm of said grinding jig such that they fit flush against said butt and either said top portion or said toe portion of said gunstock, to capture and included angle $\alpha$ therebetween, and securing said upright and pad mounting arm in the adjusted position;

mounting said recoil pad to said pad mounting arm; and manually manipulating said grinding jig with said pad mounted thereto against a sanding or grinding instrument to ablate a portion of said recoil pad.

12. The method of claim 11, wherein the method further comprises the steps of capturing the included angles for both said top and toe portions of said gunstock and manually manipulating said grinding jig with said pad mounted thereto against a sanding or grinding instrument to abate a portion of said recoil pad in the area corresponding to both said top and toe portions of said gunstock.

* * * * *